US007654530B2

(12) United States Patent
Smith et al.

(10) Patent No.: US 7,654,530 B2
(45) Date of Patent: Feb. 2, 2010

(54) CASINO-TYPE WAGERING GAME BASED ON CARD COLOR

(76) Inventors: Ray Smith, 546 E. Curtis St., Linden, NJ (US) 07036; Amanda Tears Smith, 546 E. Curtis St., Linden, NJ (US) 07036

( * ) Notice: Subject to any disclaimer, the term of this patent is extended or adjusted under 35 U.S.C. 154(b) by 0 days.

(21) Appl. No.: 11/593,796

(22) Filed: Nov. 7, 2006

(65) Prior Publication Data

US 2008/0106037 A1 May 8, 2008

(51) Int. Cl.
*A63F 1/00* (2006.01)

(52) U.S. Cl. ..... 273/274

(58) Field of Classification Search ..... 273/274, 273/292; 463/12, 13

See application file for complete search history.

(56) References Cited

U.S. PATENT DOCUMENTS

| | | | | | |
|---|---|---|---|---|---|
| 5,154,429 | A | * | 10/1992 | LeVasseur | 273/292 |
| 5,431,407 | A | * | 7/1995 | Hofberg et al. | 273/292 |
| 5,593,161 | A | * | 1/1997 | Boylan et al. | 273/274 |
| 5,632,485 | A | | 5/1997 | Woodland et al. | 273/292 |
| 5,636,843 | A | | 6/1997 | Roberts | 273/292 |
| 5,718,431 | A | * | 2/1998 | Ornstein | 273/292 |
| 5,816,577 | A | * | 10/1998 | Preston et al. | 273/292 |
| 5,921,550 | A | * | 7/1999 | Awada | 273/292 |
| 6,227,969 | B1 | | 5/2001 | Yoseloff | 463/13 |
| 6,550,772 | B1 | * | 4/2003 | Streeks et al. | 273/292 |
| 6,581,936 | B1 | * | 6/2003 | Zoccolillo et al. | 273/274 |
| 6,692,003 | B2 | | 2/2004 | Potter et al. | 273/274 |
| 6,789,800 | B2 | | 9/2004 | Webb | 273/292 |
| 6,955,599 | B2 | * | 10/2005 | Bourbour et al. | 463/13 |
| 7,029,011 | B2 | * | 4/2006 | Strong et al. | 273/292 |
| 7,048,274 | B2 | * | 5/2006 | Duncombe et al. | 273/274 |
| 7,216,869 | B1 | * | 5/2007 | Gallagher et al. | 273/274 |
| 7,341,510 | B2 | * | 3/2008 | Bourbour et al. | 463/13 |
| 2002/0008356 | A1 | * | 1/2002 | De Keller | 273/292 |
| 2004/0056419 | A1 | * | 3/2004 | Wirth | 273/274 |

* cited by examiner

*Primary Examiner*—William M Pierce
(74) *Attorney, Agent, or Firm*—Mark A. Litman & Associates, P.A.

(57) ABSTRACT

A source of symbols with two primary distinguishable characteristics is provided in a wagering environment. A player has wagering opportunities on a sequence of events, wagering on either of the primary distinguishable characteristics for each event in the sequence of events. Playing cards may be used as the source of symbols, such as a 52-card standard deck with one or two jokers or other non-standard cards. Wagers can be placed on each of the number of events in the sequence and special events that occur in the sequence (all symbols of the same characteristic, a particular card or other predetermined events). Side bets may also be placed on the events. Bets may be placed on the color of a limited number of cards dealt to a community flop, with the joker(s) providing a basis for house retention or profits on wagers.

24 Claims, 3 Drawing Sheets

CASINO-TYPE WAGERING GAME BASED ON CARD COLOR

BACKGROUND OF THE INVENTION

1. Field of the Invention

The present invention relates to the field of wagering, casino or slot machine wagering, wagering using symbol-bearing objects with multiple colors, and particularly games wagering on colors of playing cards.

2. Background of the Art

Card games have always been popular as wagering games. The history of card games reaches back into biblical times. There are basically two main formats for play of card games, games in which combinations of cards are ranked (e.g., poker-type games) and games in which values of cards are counted (e.g., blackjack and baccarat-type games). There are also some games that have combined these two types of play, as by using hands or combinations of hands from a blackjack game to form poker hands.

Casino-type wagering games are also played in formats of players-versus-players, players-versus-dealers and players' hands versus a paytable. Some casino games also combine one or more of these game formats, as by players wagering in player-versus-dealer poker games, with an additional wagering event on achieving particularly high ranks in player hands, as is done in Three-Card Poker® games.

Examples of some of the variant casino wagering game formats disclosed in the literature include U.S. Pat. No. 5,636,843 (Roberts) that discloses a process and apparatus for making side wagers or proposition (prop) bets in a table or video game. The game is a method of playing a single card game based upon cards dealt to a player from a deck of playing cards comprising: providing a deck of playing cards; providing a game table with a table top area, a dealer's position, at least one player's position, a first wager area on the table top area adjacent to the player's position and plural second wager areas on the table top area adjacent to the player's position; the player placing a first wager based upon the outcome of the game involving the cards and based upon the winning of the card game, wherein the first wager is placed upon the first area adjacent to the player's position on the table top area; the player placing at least two second prop wagers independent from playing the card game itself and whether said player wins the card game, the second prop wager is based upon the player playing for an occurrence of one or more suit, color, face card or odd and even numbered combinations of all cards that are dealt from the deck to the player during the card game, the second wager is placed upon the second area adjacent to the player's position; the dealer dealing a hand of cards to the player; the dealer selectively dealing or not dealing a card or cards to the player based upon the decision of the player; the dealer paying the player a benefit when the player wins the first wager based upon the winning of the card game; the dealer paying the player a benefit when the player wins any second wager based upon the occurrence of one or more suit, color, face card or odd and even numbered combinations of cards as of the end of the game, independent of whether the player wins the first wager.

In addition to these wagering options, some alternative wagering options are described in the specification of the Roberts patent. These options include:

5. The first two cards received by a player will be cards in the same suit from the group comprising aces, twos, threes and fours paying 40 to 1.

6. The first two cards received by a player and the dealer up card will each be cards of the same suit from the group comprising aces, twos, threes, and fours paying 80 to 1.

There are thus two wagers based upon cards being the same suit.

U.S. Pat. No. 5,632,485 (Woodland et al.) describes a side bet wager on only the player's cards. The patent describes the game as: "A method of playing a card game comprising the steps of: providing a deck of cards comprising a plurality of different numerical values; providing at least one player with the opportunity to place a single wager on whether the first two cards displayed to said player will be one of a predetermined plurality of two-card winning combinations, and wherein said plurality of two-card winning combinations comprises a first winning combination of cards having a cumulative value of twelve and a second winning combination of cards having a cumulative value of thirteen to sixteen initially displaying two cards to each player; and resolving each wager by providing a winning payout to a player who placed correct wager." The wager is on ranges of point counts in a player's 2-card hand.

U.S. Pat. No. 6,789,800 (Webb) teaches a method of playing a side game in combination with a game of chance where a dealer hand of playing cards is dealt to a dealer and a player hand of playing cards is dealt to a player. The method includes receiving a side game wager from the player, wherein after dealing the dealer hand and the player hand, all playing cards from the dealer hand and player hand are combined into a combined hand. The side game wager is resolved according to the playing cards in the combined hand. Typically, the side game wager is resolved according to non-poker combinations, such as characteristics of the playing cards including card color, picture cards or the like.

U.S. Pat. No. 6,227,969 (Yoseloff) describes a side game with potential wagering along with an underlying game. The side game may include the use of symbols or cards or card figures, and may be played live, on video gaming apparatus, or with a combination of live play and various display means, including, but not limited to, cathode ray tubes (monitors), light-emitting diodes (LED's), Liquid Crystal Displays (LCD's), plasma displays and other video gaming displays. A method of playing both an underlying game and a side bet game comprises the steps of: a) playing an underlying game in which at least two cards are received and at least two cards are kept by a player at the end of an underlying game and at least one wager is placed by the player on the underlying game, b) a player placing a wager on a side bet game, c) providing to the view of the player at least two randomly generated cards which become a part of the side bet game, d) comparing the at least two cards kept at the end of the underlying game to the at least two randomly generated cards which become part of the side bet game, and e) determining a level of correspondence between the at least two cards kept at the end of the underlying game and the at least two randomly generated cards which become part of the side bet game. Wagers may be placed at any time before, during or after play of the underlying game.

U.S. Pat. No. 6,692,003 (Potter et al.) describes a method wherein a side bet game is integrated with a base casino game. The side bet is based on the outcome of a random event or multiple random events that takes place before the base casino game begins. A wide variety of random events could be utilized, such as: the value, color or suit of a random card, the roll of dice, the spin of a wheel or slot reel, the flip of a coin, electronically displaying a random number on display means, etc. If the player wins the side bet, both the amount wagered and the amount won become a mandatory wager, and must be wagered on the immediately following hand of the base casino game. One type of embodiment of the present invention will require that if the player loses the side bet game, the side bet is collected, and the player must place a wager in order to participate in the immediately following hand of the base casino game. Another type of embodiment of the present invention will require that if the player loses the side bet only a portion of the side bet will be collected the remainder must be wagered on the base casino game.

In spite of the various games available, it is still desirable to design new casino wagering games that are easily understood by players, and offer a reasonable frequency of player wins and reasonable return for the casino.

SUMMARY OF THE INVENTION

A source of symbols with two primary distinguishable characteristics is provided in a wagering environment. A player has wagering opportunities on a sequence of events, wagering on either of the primary distinguishable characteristics for each event in the sequence of events. Playing cards may be used as the source of symbols, such as a 52-card standard deck with one or two jokers or other non-standard cards. Wagers can be placed on each of the number of events in the sequence and special events that occur in the sequence (all symbols of the same characteristic, a particular card or other predetermined events). Side bets may also be placed on the events. Bets may be placed on the color of a limited number of cards dealt to a community flop, with the joker(s) providing a basis for house retention or profits on wagers.

DETAILED DESCRIPTION OF THE INVENTION

Figure 1:
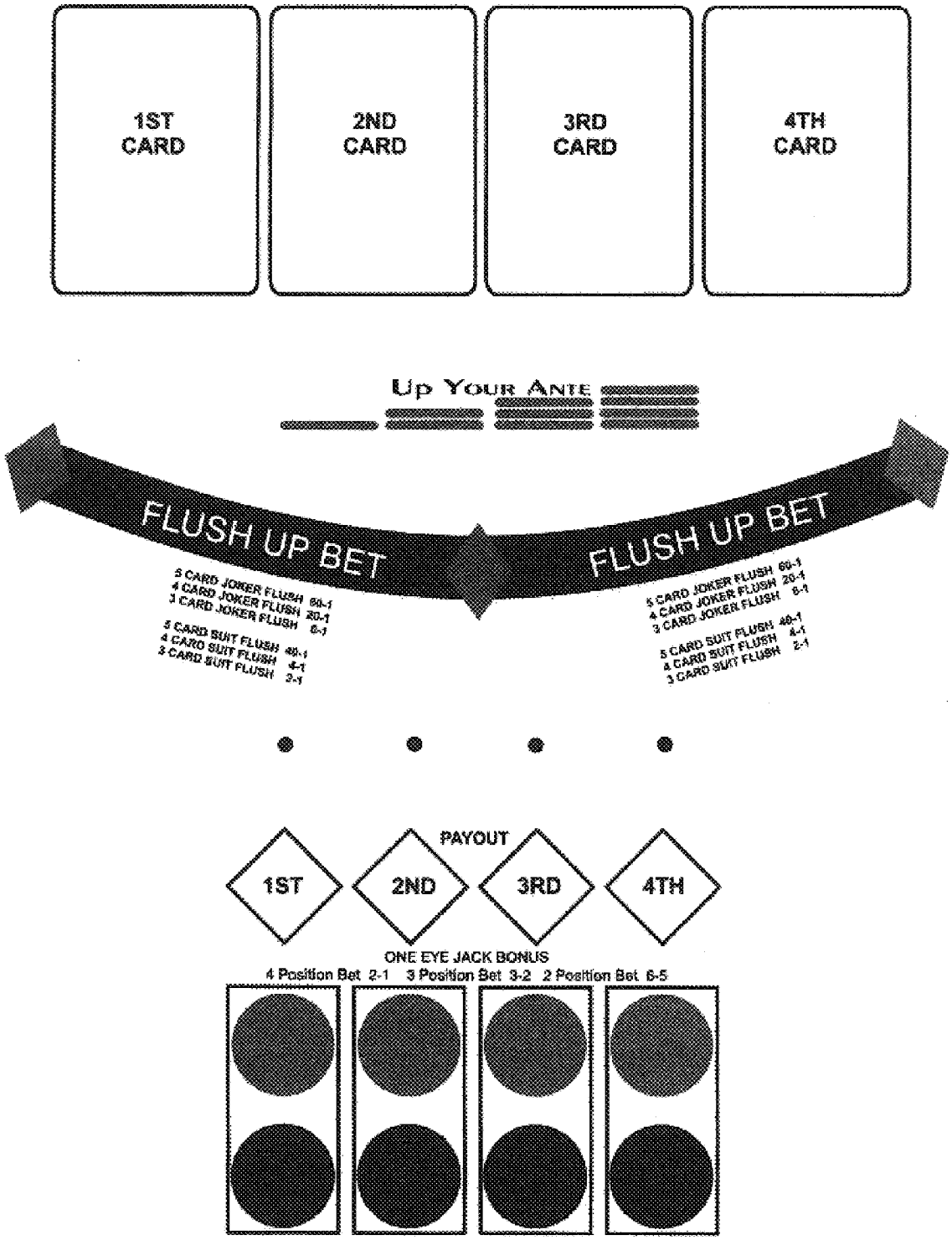
FIG. 1 shows a first layout and odds format for a variation of Up Your Ante™ game.
Figure 2:
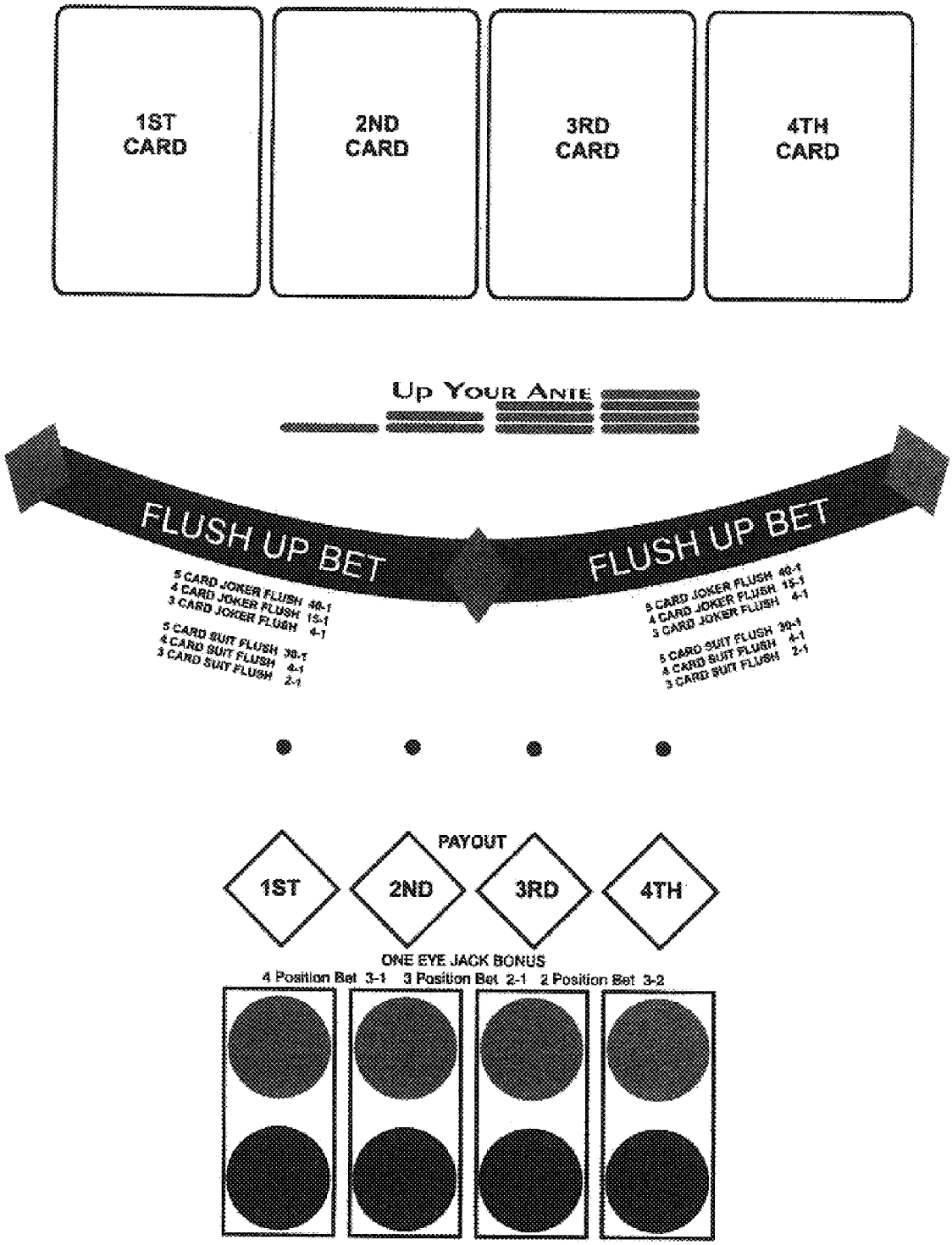
FIG. 2 shows a second layout and odds format for a variation of Up Your Ante™ game.
Figure 3:
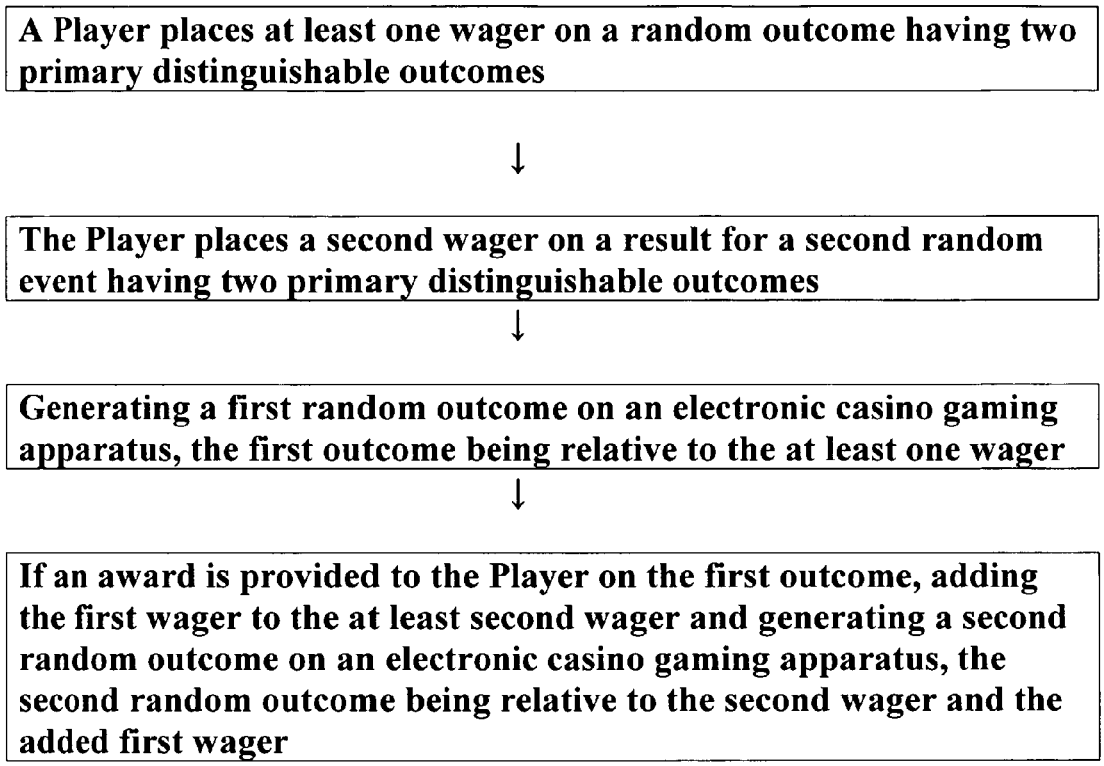
FIG. 3 shows a flow diagram of a process according to the present invention.

A source of symbols with two primary distinguishable characteristics (e.g., color, symbols, odd and even, large and small, etc.) is provided in a wagering environment. A player has wagering opportunities on a sequence of events (e.g., 2, 3, 4, 5, 6 or more events), the player wagering on either of the primary distinguishable characteristics for each event in the sequence of events. Playing cards may be used as the source of symbols, such as a 52-card standard deck with one or two jokers or other non-standard cards. Wagers can be placed on each of the number of events in the sequence and special events that occur in the sequence (all symbols of the same characteristic, a particular card or other predetermined events). Side bets may also be placed on the events. Bets may be placed on the color of a limited number of cards dealt to a community flop, with the joker(s) providing a basis for house retention or profits on wagers.

The term "primary distinguishable characteristics means that two of the available symbols are approximately (if not exactly) equal in probability and account for at least 90% of all outcomes in each event. For example, in the use of a standard playing card deck with one joker, the probabilities are 26/53 for a symbol being black, 26/53 for a symbol being red, and 1/53 for a symbol being neither red nor black (a joker). It is possible to take a standard deck (without jokers) and then remove two or three 7s, forming a 50-card or 49-card deck. The 50-card deck would provide event probabilities such as 24/50 above a value of 7, 24/50 below a value of 7, and 2/50 cards exactly at 7. Players could wager on above-7 and below-7, with the number of 7s providing the basis of a house advantage in the game. As can be seen, by appropriate selection of the total number of symbols available and the distribution/number of non-primary distinguishable characteristics, the house advantage can be tailored to allow for other wagering events such as side bets, progressive wagers, and bonus payouts. The game can be played both with live physical elements (e.g., cards, roulette wheel, etc.) or on an electronic platform such as a video game, or on the internet.

The game will be discussed with respect to a set of rules, symbol formats and examples defining an embodiment of the generic scope of the invention played as a game referred to herein as "UP YOUR ANTE™" casino game, but these limited examples are to be considered as non-limiting examples of a species within the generic concepts of the present invention. Up Your Ante™ casino game is an example of a card game played with a standard 52-card deck plus 1 or 2 jokers to define the house advantage. The use of a single card provides approximately half the house advantage on the underlying game that two jokers provides. One objective in this particular game is to correctly and individually predict the color of up to 4 community cards, with no dealer-versus-player direct hand competition. The player has a table layout in front of him/her with 4 possible betting positions that have at least two possible bets of at least red or black. The player may bet on any of the 1, 2, 3 or 4 betting positions. By placing a wager on any of the 4 betting positions, the player is betting on the color of the corresponding community card that is to be revealed in correspondence with that position. Any bet that is a part of a consecutive sequence of bets is known as an Ante Up Bet. Winning an Ante Up Bet with a One-Eyed Jack as one of the community cards qualifies a player for a bonus if he/she also wins all of his/her Ante Up Bets. There is also an optional side bet called a Flush Up Bet, described in greater detail later.

Rules of Ante Up™ Poker

THE GAME STARTS WITH EACH PLAYER WAGERING ON ANY OF THE 4 BETTING POSITIONS BY CHOOSING A COLOR RED OR BLACK IN EACH OF THOSE BETTING POSITIONS. PLAYER MAY ALSO BET (OR IN SOME JURISDICTIONS IT MIGHT BE ALLOWED TO ONLY BET) ON THE OPTIONAL BET CALLED FLUSH UP. THE BETS MAY VARY BETWEEN EACH OF THE FOUR POSITIONS.

1. It is preferred that all of the underlying four bets be made before any one of the community cards is revealed, although the player advantage is so slightly improved by revelation of one card (and even three cards), that wagers may be allowed on subsequent wagering positions after 1, 2 or even 3 of the community cards is revealed, especially when there are two Jokers. Such subsequent wagering, including an increase in wagering after the initial wagers were made, may be allowed under specified conditions such as only if there is at least one match in the first two cards, the first three cards, and if no Joker has appeared.
2. Betting Limitations on Ante Up Bets:
   One Joker Version: Highest bet may not exceed 8× lowest bet
   * Two Joker Version: Highest bet may not exceed 100× lowest bet
3. The following is an optional format or protocol of dealing and is not an essential part of the game, but is done to give players a perception of greater randomness in the cards dealt. After all bets are placed, the dealer will bury one card. The dealer will then deal 4 community cards face down, starting with the 1st community card position that represents the 1st betting position. The dealer will then bury the next card. The dealer will then deal one card to each player that wagered on the Flush Up Bet. At this time all cards in the game are dealt. The dealer will place all remaining cards in the deck to the side and out of play.

4. The dealer will now turn over the 1st community card and compare the color of that card to the color the player wagered on in the 1st betting position (if this bet was made):

If there is no color match or the card is a Joker, the player loses that bet. Lost bets will be placed on the Dealer Dot* or the wager collected and stored by the house.

If there is a color match, the player will win 1 to 1 on his wager on that matching position Winning bets will be placed on the Pay Out area.

If there is no bet on the 2nd betting position then the player keeps his ante wager from the first position.

If there is a 2nd betting position wager, then the 1st betting position wager would be moved over to the 2nd betting position and would be in play on the 2nd community card.

5. The dealer will now turn over the 2nd community card and compare the color of that card to the color the player wagered on in the 2nd betting position (if this bet was made):

If there is no color match or the card is a Joker, the player loses that bet, including any amounts carried over from the 1st position wager. Lost bets will be placed on the Dealer Dot* or collected by the house.

If there is a color match, the player will win 1 to 1 on his $2^{nd}$ position ante wager and including any amounts carried over from the 1st wager. Winning bets will be placed on the Pay Out area.

If there is no bet on the 3rd betting position then the player keeps his cumulative ante wager (from the $1^{st}$ position ante wager and the $2^{nd}$ position ante wager).

If there is a 3rd betting position wager, then the 2nd betting position wager would be moved over to the 3rd betting position and would be in play on the 3rd community card. It is an optional house rule as to whether the first position wager would also be moved over to the third position of the first position ante wager withdrawn by the Player.

6. The dealer will now turn over the 3rd community card and compare the color of that card to the color the player wagered on in the 3rd betting position (if this bet was made):

If there is no color match or the card is a Joker, the player loses that bet, including any amounts carried over from the 2nd position wager, and if the first position ante wager was carried over. Lost bets will be placed on the Dealer Dot*.

If there is a color match, the player will win 1 to 1 on his wager, including any amounts carried over from the 2nd wager. Winning bets will be placed on the Pay Out area.

If there is no bet on the 4th betting position then the player keeps his cumulative ante wager:

If there is a 4th betting position wager, then the 3rd betting position wager would be moved over to the 4th betting position and would be in play on the 4th community card.

The dealer will now turn over the 4th community card and compare the color of that card to the color the player wagered on in the 4th betting position (if this bet was made):

If there is no color match or the card is a Joker, the player loses that bet, including any amounts carried over from the 3rd position wager. Lost bets will be placed on the Dealer Dot* or collected by the house.

If there is a color match, the player will win 1 to 1 on his wager including any and all amounts carried over from the 3rd position wager. Winning bets will be placed on the Pay Out area and the player keeps his cumulative ante wager.

7. *Dealer's Dot is a place where the Dealer keeps all losing bets. The Pay Out is where the Dealer pays winning bets. These areas are used to keep track of how many consecutive bets a player wagered and from what betting position they started. After resolving all 4 position wagers, players will receive any amounts in their respective Pay Out areas. Dealer will collect all lost bets at this time also.

One-Eyed Jack Bonus

When a player makes Ante Up Bets that consist of 2, 3, or 4 consecutive bets and wins all consecutive bets, the Player is entitled to a bonus on his last cumulative wager, if 1 or 2 of his winning cards is a One-Eyed Jack. The following Table 1 shows the different pay out odds for different Ante Up Bets. For example, if the player places 3 consecutive bets and wins all 3 bets with a One-Eyed Jack as a winning card, then the player wins 2 to 1 on the final cumulative bet (for the version of the game with 2 jokers). Note that when the player wins the bonus, the Player is paid the bonus amount instead of even money, not in addition to even money. Pay Out bonus will be paid at the end of any ante up bet conclusion.

TABLE 1

Table1: Bonus pay out odds for consecutive wins with one-eyed Jacks.

| Ante Up Bet | One Joker Game | Two Jokers Game |
|---|---|---|
| Four consecutive bets | 2 to 1 | 3 to 1 |
| Three consecutive bets | 3 to 2 | 2 to 1 |
| Two consecutive bets | 6 to 5 | 3 to 2 |

Flush Up Side Bet

AFTER ALL FOUR BETTING POSITIONS ARE PLAYED AND PAID THE FLUSH UP BET WILL BE SETTLED.

One Joker Analysis

To analyze Up Your Ante™ game play, a program was written in Java to analyze all possible betting scenarios. To do so, the program executed the following steps for each betting scenario:

1. Cycle through all possible ways to place each wager on either red or black. For a single bet, there are 2 possible ways to do this. For 2 consecutive wagers there are 4 ways, for 3 consecutive wagers there are 8 ways, and for 4 consecutive wagers, there are 16 ways.
2. For each of the color betting patterns in step 1, cycle through all 292,825 ways to deal 4 cards to the player from a 53-card deck.
3. For each combination of cards in step 2, resolve all of the player's wagers and note the amount won or lost.

4. Keep a running tally of the results from step 3. After cycling through all possible ways to deal the players 4 cards, calculate the expected value[1] of the current color-wagering pattern.

[1]The expected value is defined as the weighted average of all possible outcomes of an event. Suppose there are n possible outcomes of an event. Let $x_i$=value of the ith outcome and $p_i$=the probability the ith outcome. Then expected value=$\Sigma x_i * p_i$, for i=1, 2, . . . , n.

5. Compare the results from step 4 and take the highest of these values. The highest of these values represents the best color-wagering pattern for a certain betting scenario. The negative of this figure is the house advantage.

The Table 2 below summarizes the results from the program for all possible betting scenarios. (All house edge figures were calculated relative to the sum of all wagers placed.) The table also shows the best amount for the player to wager in each scenario. For instance, when betting on all 4 cards, the player should wager 8× as much on the last 2 bets as he did on the first 2 bets. Furthermore, the player should wager the same amount on the first 2 bets.

TABLE 2

Table 2: House edge summary for all possible betting patterns.

| Wager Type | Best Wager Pattern | Best Color Pattern | House Edge |
|---|---|---|---|
| Single Bet | Any | R or B | 1.8868% |
| Two Consecutive Bets | 1-8 | RB or BR | 1.5167% |
| Three Consecutive Bets | 1-8-8 | RBR or BRB | 1.2392% |
| Four Consecutive Bets | 1-1-8-8 | BRBR or BRBR | 1.0509% |

The next 4 tables show the expected value details of each betting scenario, assuming the player is making the best wagering pattern (as shown in Table 2) and alternating the Player bets from black to red.

TABLE 3

Table 3: Expected value and house edge details for a single wager

| Outcome | Pays | Probability | Frequency | Return |
|---|---|---|---|---|
| L | −1 | 0.509434 | 1 in 2.0 | −0.509434 |
| W | 1 | 0.490566 | 1 in 2.0 | 0.490566 |
| Total | | 1.000000 | | −0.018868 |
| | | | House Edge | 1.8868% |

TABLE 4

Table 4: Expected value and house edge details for 2 consecutive wagers.

| Outcome | Pays | Probability | Frequency | Return |
|---|---|---|---|---|
| LL | −9 | 0.264151 | 1 in 3.8 | −0.264151 |
| WL | −8 | 0.245283 | 1 in 4.1 | −0.218029 |
| LW | 7 | 0.245283 | 1 in 4.1 | 0.190776 |
| WW | 10 | 0.226778 | 1 in 4.4 | 0.251975 |
| WW bonus | 11.8 | 0.018505 | 1 in 54.0 | 0.024262 |
| Total | | 1.000000 | | −0.015167 |
| | | | House Edge | 1.5167% |

TABLE 5

Table 5: Expected value and house edge details for 3 consecutive wagers.

| Outcome | Pays | Probability | Frequency | Return |
|---|---|---|---|---|
| LLL | −17 | 0.134480 | 1 in 7.4 | −0.134480 |
| WLL | −16 | 0.129671 | 1 in 7.7 | −0.122043 |
| LWL | −9 | 0.120237 | 1 in 8.3 | −0.063655 |
| WWL | −7 | 0.125046 | 1 in 8.0 | −0.051490 |
| LLW | −1 | 0.129671 | 1 in 7.7 | −0.007628 |
| WLW | 0 | 0.115612 | 1 in 8.6 | 0.000000 |
| LWW | 23 | 0.125046 | 1 in 8.0 | 0.169180 |
| WWW | 27 | 0.106719 | 1 in 9.4 | 0.169495 |
| WWW bonus | 35.5 | 0.013518 | 1 in 74.0 | 0.028228 |
| Total | | 1.000000 | | −0.012392 |
| | | | House Edge | 1.2392% |

TABLE 6

Table 6: Expected value and House Edge Details for 4 Consecutive Wagers

| Outcome | Pays | Probability | Frequency | Return |
|---|---|---|---|---|
| LLLL | −18 | 0.069737 | 1 in 14.3 | −0.069737 |
| WLLL | −17 | 0.064743 | 1 in 15.4 | −0.061146 |
| LWLL | −17 | 0.064743 | 1 in 15.4 | −0.061146 |
| WWLL | −15 | 0.064928 | 1 in 15.4 | −0.054107 |
| LLWL | −10 | 0.064743 | 1 in 15.4 | −0.035968 |
| WLWL | −9 | 0.055494 | 1 in 18.0 | −0.027747 |
| LWWL | −8 | 0.064928 | 1 in 15.4 | −0.028857 |
| WWWL | −5 | 0.060118 | 1 in 16.6 | −0.016700 |
| LLLW | −2 | 0.064743 | 1 in 15.4 | −0.007194 |
| WLLW | −1 | 0.064928 | 1 in 15.4 | −0.003607 |
| LWLW | −1 | 0.055494 | 1 in 18.0 | −0.003083 |
| WWLW | 1 | 0.060118 | 1 in 16.6 | 0.003340 |
| LLWW | 22 | 0.064928 | 1 in 15.4 | 0.079356 |
| WLWW | 23 | 0.060118 | 1 in 16.6 | 0.076818 |
| LWWW | 26 | 0.060118 | 1 in 16.6 | 0.086838 |
| WWWW | 31 | 0.051225 | 1 in 19.5 | 0.088221 |
| WWWW bonus | 49 | 0.008893 | 1 in 112.4 | 0.024209 |
| Total | | 1.000000 | | −0.010509 |
| | | | House Edge | 1.0509% |

Two Joker Analysis

To analyze the game when played with 2 jokers in the deck, a program similar to the one used to analyze the 1 joker game was used. The program executed a similar set of steps, but with 2 jokers in the deck. Also, although there are no wagering restrictions for the 2-Joker version of the game, it was assumed that the player could not bet more than 100× the table minimum.

The table below summarizes the results from the program for all possible betting scenarios. (All house edge figures were calculated relative to the sum of all wagers placed.) The table also shows the best amounts for the player to wager in each scenario. As indicated below, when the player makes 2 or more consecutive wagers, he should bet as little as possible on all but the last wager, which should be 100× any of his other wagers.

TABLE 7

Table 7: House edge summary for all possible betting patterns.

| Wager type | Best Wager Pattern | Best Color Pattern | House Edge |
|---|---|---|---|
| Single Bet | Any | R or B | 3.7037% |
| Two Consecutive Bets | 1-100 | RB or BR | 2.8217% |
| Three Consecutive Bets | 1-1-100 | RBR or BRB | 2.4537% |
| Four Consecutive Bets | 1-1-1-100 | BRBR or BRBR | 2.1031% |

The next 4 tables show the expected value details of each betting scenario, assuming the player is making the best wagering pattern (as shown in table 7) and alternating his bets from black to red.

TABLE 8

Table 8: Expected value and house edge details for a single wager.

| Outcome | Pays | Probability | Frequency | Return |
|---|---|---|---|---|
| L | −1 | 0.518519 | 1 in 1.9 | −0.518519 |
| W | 1 | 0.481481 | 1 in 2.1 | 0.481481 |
| Total | | 1.000000 | | −0.037037 |
| | | | House Edge | 3.7037% |

TABLE 9

Table 9: Expected value and house edge details for 2 consecutive wagers.

| Outcome | Pays | Probability | Frequency | Return |
|---|---|---|---|---|
| LL | −101 | 0.273235 | 1 in 3.7 | −0.273235 |
| WL | −100 | 0.245283 | 1 in 4.1 | −0.242854 |
| LW | 99 | 0.245283 | 1 in 4.1 | 0.240426 |
| WW | 102 | 0.218379 | 1 in 4.6 | 0.220541 |
| WW bonus | 152.5 | 0.017820 | 1 in 56.1 | 0.026906 |
| Total | | 1.000000 | | −0.028217 |
| | | | House Edge | 2.8217% |

TABLE 10

Table 10: Expected value and house edge details for 3 consecutive wagers.

| Outcome | Pays | Probability | Frequency | Return |
|---|---|---|---|---|
| LLL | −102 | 0.141509 | 1 in 7.1 | −0.141509 |
| WLL | −101 | 0.131726 | 1 in 7.6 | −0.130435 |
| LWL | −101 | 0.122642 | 1 in 8.2 | −0.121439 |
| WWL | −99 | 0.122642 | 1 in 8.2 | −0.119034 |
| LLW | 98 | 0.131726 | 1 in 7.6 | 0.126560 |
| WLW | 99 | 0.113557 | 1 in 8.8 | 0.110217 |
| LWW | 101 | 0.122642 | 1 in 8.2 | 0.121439 |
| WWW | 105 | 0.100790 | 1 in 9.9 | 0.103755 |
| WWW bonus | 207 | 0.012767 | 1 in 78.3 | 0.025909 |
| Total | | 1.000000 | | −0.024537 |
| | | | House Edge | 2.4537% |

TABLE 11

TABLE 11: EXPECTED VALUE AND HOUSE EDGE DETAILS FOR 4 CONSECUTIVE WAGERS

| Outcome | Pays | Probability | Frequency | Return |
|---|---|---|---|---|
| LLLL | −103 | 0.074533 | 1 in 13.4 | −0.074533 |
| WLLL | −102 | 0.066976 | 1 in 14.9 | −0.066326 |
| LWLL | −102 | 0.066976 | 1 in 14.9 | −0.066326 |
| WWLL | −100 | 0.064750 | 1 in 15.4 | −0.062864 |
| LLWL | −102 | 0.066976 | 1 in 14.9 | −0.066326 |
| WLWL | −101 | 0.055665 | 1 in 18.0 | −0.054584 |
| LWWL | −100 | 0.064750 | 1 in 15.4 | −0.062864 |
| WWWL | −97 | 0.057892 | 1 in 17.3 | −0.054519 |
| LLLW | 97 | 0.066976 | 1 in 14.9 | 0.063075 |
| WLLW | 98 | 0.064750 | 1 in 15.4 | 0.061607 |
| LWLW | 98 | 0.055665 | 1 in 18.0 | 0.052963 |
| WWLW | 100 | 0.057892 | 1 in 17.3 | 0.056206 |
| LLWW | 100 | 0.064750 | 1 in 15.4 | 0.062864 |
| WLWW | 101 | 0.057892 | 1 in 17.3 | 0.056768 |
| LWWW | 104 | 0.057892 | 1 in 17.3 | 0.058454 |
| WWWW | 109 | 0.047431 | 1 in 21.1 | 0.050194 |
| WWWW bonus | 315 | 0.008234 | 1 in 121.4 | 0.025183 |
| Total | | 1.000000 | | −0.021031 |
| | | | House Edge | 2.1031% |

Flush Up Bet Analysis

The Flush Up Bet™ wager is an optional side bet that players may wager on at the start of each round. The dealer will deal a Flush Up card to all players who have wagered on the Flush Up Bet™ wager. To win, players need to match the suit of the Flush Up card to at least 2 of the suits of their 4 community cards. A Joker dealt as the player's Flush Up card will be treated as a wild card (any suit). The following list describes each of the winning hands on the pay table:

- The Flush Up card is not a Joker and matches the suit of 2 position cards
- The Flush Up card is a Joker and 2 position cards are of the same suit
- The Flush Up card is not a Joker and matches the suit of 3 position cards
- The Flush Up card is a Joker and 3 position cards are of the same suit
- The Flush Up card is not a Joker and matches the suit of 4 position cards
- The Flush Up card is a Joker and all 4 position cards are of the same suit The tables below show the expected values and corresponding house edges for two different versions of this bet.

TABLE 12

Table 12: Flush Up Side Bet with 1 Joker.

| Hand | Pays | Combinations | Probability | Frequency | Return |
|---|---|---|---|---|---|
| Joker + 4 Suited Cards | 60 | 2,860 | 0.000199 | 1 in 5016.9 | 0.011960 |
| Suit + 4 Suited Cards | 40 | 25,740 | 0.001794 | 1 in 557.4 | 0.071757 |
| Joker + 3 Suited Cards | 20 | 44,616 | 0.003109 | 1 in 321.6 | 0.062189 |
| Suit + 3 Suited Cards | 4 | 457,600 | 0.031892 | 1 in 31.4 | 0.127568 |
| Joker + 2 Suited Cards | 6 | 194,688 | 0.013569 | 1 in 73.7 | 0.081412 |
| Suit + 2 Suited Cards | 2 | 2,676,960 | 0.186568 | 1 in 5.4 | 0.373136 |
| Other | −1 | 10,945,961 | 0.762868 | 1 in 1.3 | −0.762868 |
| Total | | 14,348,425 | 1.000000 | | −0.034847 |
| | | | | House Edge | 3.4847% |

TABLE 13

Table 13: Flush Up Side Bet with 2 Jokers.

| Hand | Pays | Combinations | Probability | Frequency | Return |
|---|---|---|---|---|---|
| Joker + 4 Suited Cards | 40 | 5,720 | 0.000362 | 1 in 2764.4 | 0.014470 |
| Suit + 4 Suited Cards | 30 | 25,740 | 0.001628 | 1 in 614.3 | 0.048835 |
| Joker + 3 Suited Cards | 15 | 91,520 | 0.005788 | 1 in 172.8 | 0.086817 |
| Suit + 3 Suited Cards | 4 | 469,040 | 0.029663 | 1 in 33.7 | 0.118650 |
| Joker + 2 Suited Cards | 4 | 413,712 | 0.026164 | 1 in 38.2 | 0.104654 |
| Suit + 2 Suited Cards | 2 | 2,814,240 | 0.177975 | 1 in 5.6 | 0.355950 |
| Other | −1 | 11,992,578 | 0.758422 | 1 in 1.3 | −0.758422 |
| Total | | 15,812,550 | 1.000000 | | −0.029046 |
| | | | | House Edge | 2.9046% |

The various side bets and specialty bets-that may be included with the play of the game as described above may include at least:

Single Bet Single bet can be placed on position 1, 2, 3 or 4; 2 Single bets can be made on positions (1 and 3) (2 and 4) (1 and 4); Ante Up Bets are a bet that the ante from 1 winning position is added to the next betting position; 2 Position Ante Up Bet—can be placed on positions (1 and 2) (2 and 3) (3 and 4);

Two Consecutive Wins: 3 Position Ante Up Bet—can be placed on positions (1, 2 and 3) (2, 3 or 4)

Three Consecutive Wins; 4 Position Ante Up Bet—can be placed on position (1, 2, 3 and 4)

Four Consecutive Wins

Combo Bet—can be placed on position (1 and 3, 4) (1, 2 and 4) Two Consecutive Wins

What is claimed:

1. A method of playing a wagering game comprising at least two separate random outcome events:

a player placing at least one first ante wager on a result for a first random outcome having two primary distinguishable outcomes that have a total probability for the two primary distinguishable outcomes that is less than 100% at the time of the first wager;

the player placing at least one second ante wager on a result for a second random outcome having two primary distinguishable outcomes that have a total probability for the two primary distinguishable outcomes that is less than 100% at the time of the second wager;

generating a first random outcome on a casino gaming electronic apparatus with a display screen or on a casino gaming table with playing cards relative to the first ante wager, which first random outcome provides a result that is at least one of the two primary distinguishable outcomes or an event outcome contributing to the total probability;

providing an award on the first ante wager if the first random outcome is the first result on which the first ante was placed and collecting the first ante wager if the first random outcome is other than the first result on which the first ante was placed; and if the award is provided to the player on the first random outcome, adding the first ante wager to the at least second ante wager and generating a second random outcome on the casino gaming electronic apparatus with a display screen or on the casino gaming table with playing cards, respectively relative to the second ante wager and the added first ante wager.

2. The method of claim 1 wherein after generating the second random outcome, providing an award on the second ante wager if the second random outcome is the second result on which the second ante was placed and collecting the second ante wager if the second random outcome is other than the second result on which the second ante was placed and the game is played with physical playing cards.

3. The method of claim 2 wherein if the first ante wager has been added to the second ante wager, providing an award on the first ante wager if the second random outcome is the second result on which the second ante was placed and collecting the first ante wager if the second random outcome is other than the second result on which the second ante was placed.

4. The method of claim 1 wherein a third ante wager is also placed on a result for a third random outcome having two primary distinguishable outcomes that have a total probability for the two primary distinguishable outcomes that is less than 100% at the time of the third wager.

5. The method of claim 4 wherein if an award is provided on the second ante, at least the second ante is added to the third ante wager on the third random outcome and the third random result is generated.

6. The method of claim 5 wherein if the second ante wager has been added to the third ante wager, providing an award on the second ante wager if the third random outcome is the third result on which the third ante wager was placed and collecting the second ante wager if the third random outcome is other than the third result on which the third ante was placed.

7. The method of claim 1 wherein random outcomes are provided by revelation of playing card faces.

8. The method of claim 7 wherein the two primary distinguishable outcomes comprise the color of the playing cards.

9. The method of claim 7 wherein the two primary distinguishable outcomes comprise the rank of the playing cards relative to a base rank.

10. The method of claim 7 wherein the two primary distinguishable outcomes comprise the odd or even rank of the playing cards.

11. The method of claim 7 wherein the two primary distinguishable outcomes comprise two different defined sets of the playing cards.

12. The method of claim 7 wherein playing cards are provided from a 52-card deck with one or two jokers added to the 52-card deck.

13. The method of claim 8 wherein playing cards are provided from a 52-card deck with one or two jokers added to the 52-card deck.

14. The method of claim 13 wherein after generating the second random outcome, providing an award on the second ante wager if the second random outcome is the second result on which the second ante was placed and collecting the second ante wager if the second random outcome is other than the second result on which the second ante was placed.

15. The method of claim 14 wherein if the first ante wager has been added to the second ante wager, providing an award on the first ante wager if the second random outcome is the second result on which the second ante was placed and collecting the first ante wager if the second random outcome is other than the second result on which the second ante was placed.

16. The method of claim 15 wherein if the first ante wager has been added to the second ante wager, providing an award on the first ante wager if the second random outcome is the second result on which the second ante was placed and collecting the first ante wager if the second random outcome is other than the second result on which the second ante was placed.

17. The method of claim 14 wherein a third ante wager is also placed on a result for a third random outcome having two primary distinguishable outcomes that have a total probability forte two primary distinguishable outcomes that is less than 100% at the time of the third wager.

18. The method of claim 17 wherein if an award is provided on the second ante, at least the second ante is added to the third ante wager on the third random outcome and the third random result is generated.

19. The method of claim 18 wherein if the second ante wager has been added to the third ante wager, providing an award on the second ante wager if the third random outcome is the third result on which the third ante wager was placed and collecting the second ante wager if the third random outcome is other than the third result on which the third ante was placed.

20. The method of claim 19 wherein a fourth ante wager is also placed on a result for a fourth random outcome having two primary distinguishable outcomes that have a total probability for the two primary distinguishable outcomes that is less than 100% at the time of the fourth wager.

21. The method of claim 20 wherein if an award is provided on the third ante, at least the third ante is added to the fourth ante wager on the fourth random outcome and the fourth random result is generated.

22. The method of claim 21 wherein if the third ante wager has been added to the fourth ante wager, providing an award on the third ante wager if the fourth random outcome is the fourth result on which the fourth ante wager was placed and collecting the third ante wager if the fourth random outcome is other than the fourth result on which the fourth ante was placed.

23. The method of claim 22 wherein side bets may be placed on the wagering game relating to multiple results.

24. The method of claim 1 wherein a player places a Flush-Up side bet wager to be won if players a revealed suit of a special Flush Up card to at least 2 of the suits of the player's 4 community cards.

* * * * *